United States Patent [19]

von Gehlen

[11] Patent Number: 4,987,647

[45] Date of Patent: Jan. 29, 1991

[54] SECURING A FLAT HEAD TO A TRAVELLING FLAT CHAIN BAR USING COUPLING PIN AND CIRCLIP MEANS IN A TEXTILE CARDING MACHINE

[75] Inventor: Walter von Gehlen, Mönchengladbach, Fed. Rep. of Germany

[73] Assignee: Trützschler GmbH & Co. KG, Mönchengladbach, Fed. Rep. of Germany

[21] Appl. No.: 344,978

[22] Filed: Apr. 28, 1989

[30] Foreign Application Priority Data

Apr. 28, 1988 [DE] Fed. Rep. of Germany ..... 3814412

[51] Int. Cl.[5] ..... D01G 15/02; D01G 15/08; D01G 15/24

[52] U.S. Cl. ..... 19/111; 19/110; 19/113; 19/102; 19/103; 19/104

[58] Field of Search ..... 19/102, 103, 104, 110, 19/111, 113

[56] References Cited

U.S. PATENT DOCUMENTS

| | | | |
|---|---|---|---|
| 628,216 | 7/1899 | Taylor | 19/102 |
| 3,143,771 | 8/1964 | Kluttz | 19/102 |
| 3,995,351 | 12/1976 | Otani | 19/102 |
| 4,559,674 | 12/1985 | Rimmer | 19/111 X |

FOREIGN PATENT DOCUMENTS

| | | | |
|---|---|---|---|
| 1105318 | 11/1961 | Fed. Rep. of Germany . | |
| 1856447 | 5/1962 | Fed. Rep. of Germany . | |
| 7345579 | 3/1974 | Fed. Rep. of Germany . | |
| 0183900 | 5/1887 | France | 19/102 |
| 681885 | 10/1952 | United Kingdom . | |
| 809630 | 2/1959 | United Kingdom . | |
| 842230 | 7/1960 | United Kingdom . | |
| 870424 | 6/1961 | United Kingdom . | |
| 1543334 | 4/1979 | United Kingdom . | |
| 2029869 | 4/1980 | United Kingdom | 19/113 |

*Primary Examiner*—Werner H. Schroeder
*Assistant Examiner*—Ismael Izaguirre
*Attorney, Agent, or Firm*—Spencer & Frank

[57] ABSTRACT

A travelling flat bar includes a head, an opening in the head, a coupling element received in the opening and arranged for attaching the flat bar to a flat-moving chain and a securing (locking) arrangement for readily releasably retaining the coupling element in the opening. The locking arrangement cooperates with the coupling element for form-lockingly retaining the coupling element in the opening.

3 Claims, 5 Drawing Sheets

Fig. 6a
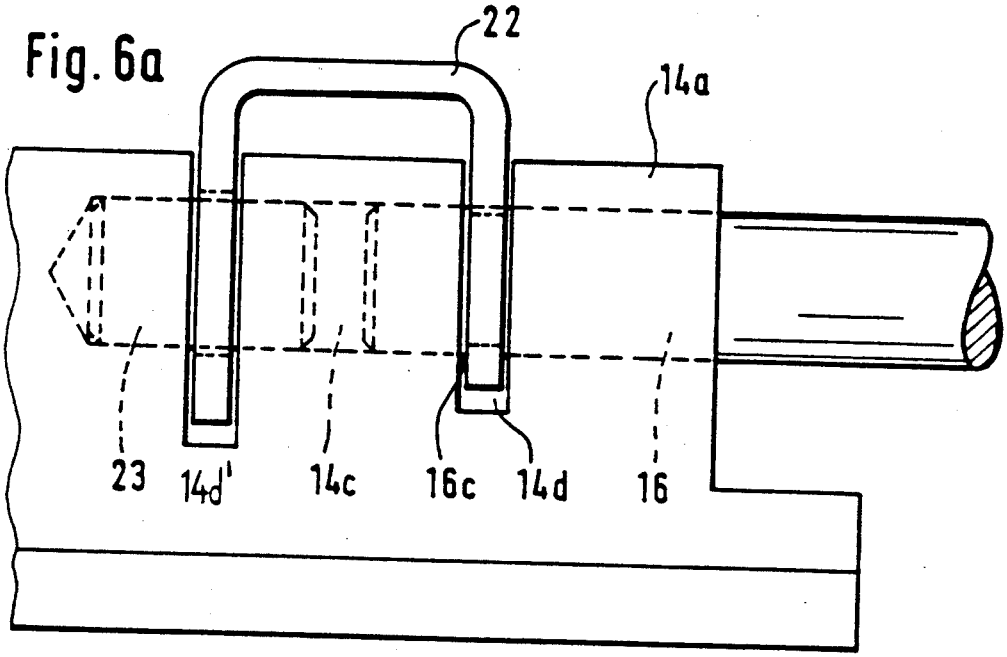
Fig. 6b
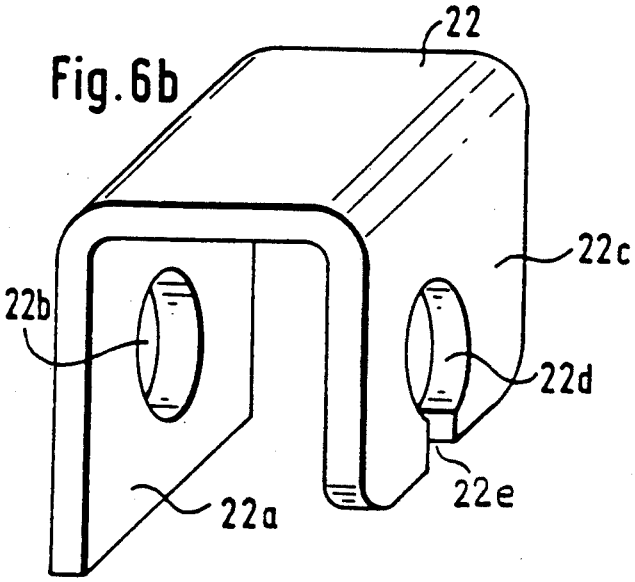
Fig. 7b
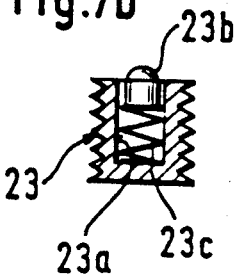
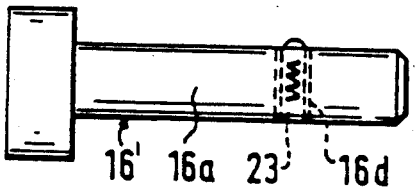
Fig. 7a
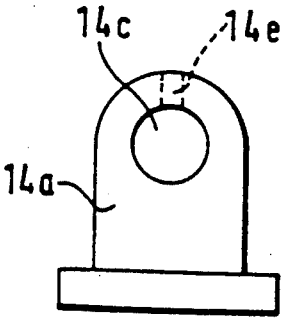
Fig. 7c

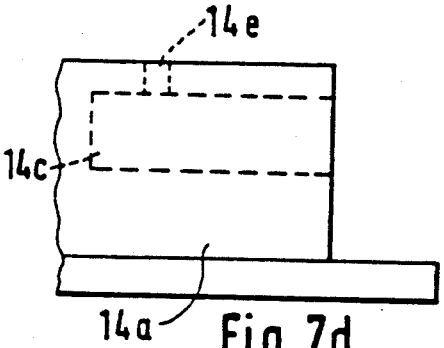
Fig. 7d
Fig. 7e
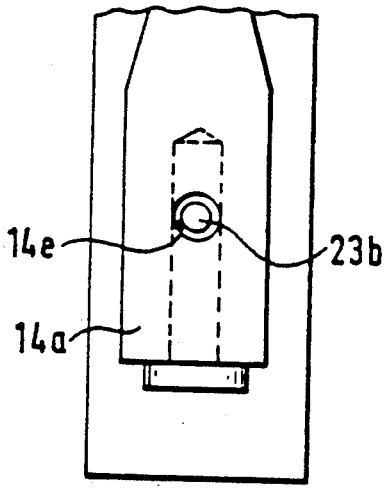
Fig. 8
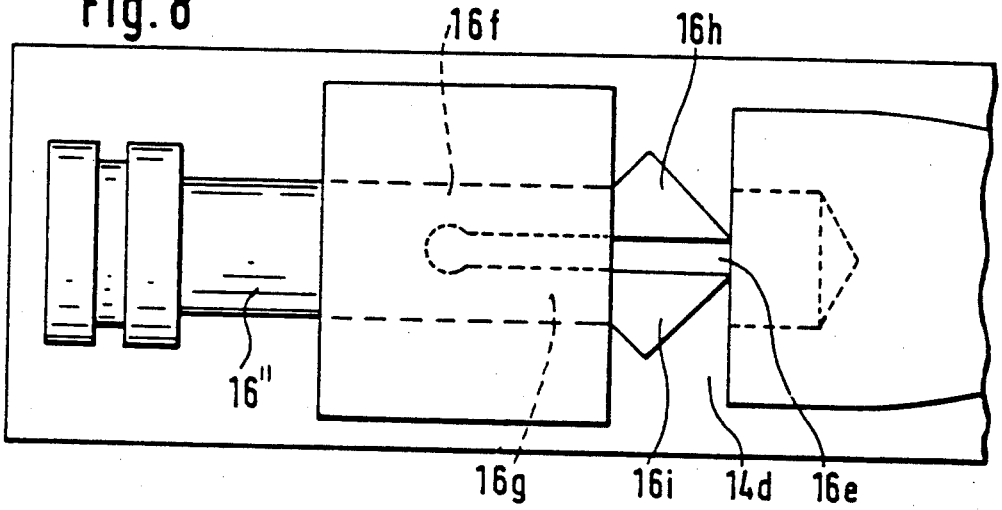
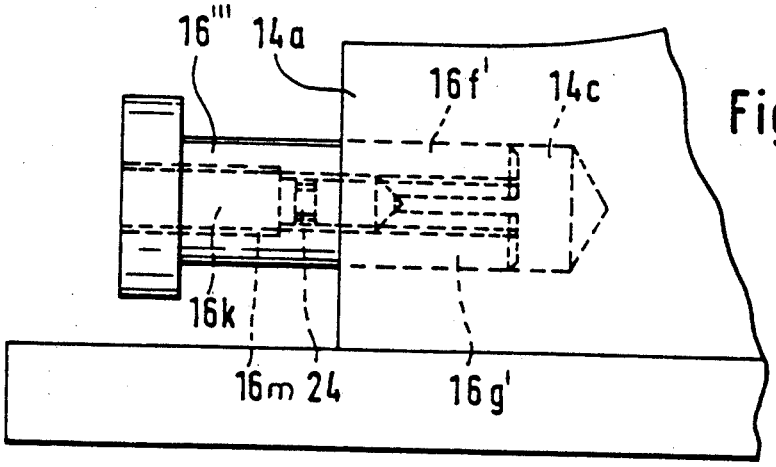
Fig. 9

SECURING A FLAT HEAD TO A TRAVELLING FLAT CHAIN BAR USING COUPLING PIN AND CIRCLIP MEANS IN A TEXTILE CARDING MACHINE

CROSS REFERENCE TO RELATED APPLICATION

This application claims the priority of Federal Republic of Germany application No. P38 14 412.3 filed Apr. 28th, 1988, which is incorporated herein by reference.

BACKGROUND OF THE INVENTION

This invention relates to a travelling flat (flat bar) for a card, wherein the flat chains are releasably secured to the outer ends of the flat heads by means of a coupling element and further, in each head terminus an opening is provided for receiving the coupling element.

In a flat of known construction the attachment of the flat chain to the flat head is effected by a flat screw which passes through a bushing at the articulation of the chain and extends into a bore which is provided in the flat head and which has an inner thread. It is a disadvantage of this arrangement that providing the inner thread is technologically complex and further, in practice, the inner thread may tend to lead to breakages of the material in the thread zone. It is also a disadvantage of the prior art flat that the flat screw must be tightened with a predetermined torque which renders, for example, a reassembling operation after replacement of clothing, very time consuming since the torque limits have to be strictly observed. In case the screw is tightened excessively, the inner thread may break out which renders the flat useless and has to be replaced

SUMMARY OF THE INVENTION

It is an object of the invention to provide an improved flat of the above-outlined type from which the discussed disadvantages are eliminated and which permits in particular a simple manufacture, a rapid assembly (installation) and a reliable locking of the coupling element in the flat head.

This object and others to become apparent as the specification progresses, are accomplished by the invention, according to which, briefly stated, the travelling flat bar includes a head, an opening in the head, a coupling element received in the opening and arranged for attaching the flat bar to a flat-moving chain and a securing (locking) arrangement for readily releasably retaining the coupling element in the opening. The locking arrangement cooperates with the coupling element for form-lockingly retaining the coupling element in the opening.

The form fitting (form locking) immobilization of the coupling element ensures a reliable locking thereof without the need of an inner thread in the flat head for the coupling element; a smooth bore, or aperture provided by milling suffices. The invention thus dispenses with a flat screw, and therefore time-consuming setting of the required torque is no longer necessary. Also, breakouts of the inner thread are no longer a problem. The immobilization of the coupling element for the flat chain has the particular advantage that assembly work on the flat chain can have a significantly shorter duration. Thus, the invention permits a simple preparation of the flat head and the coupling element as well as a rapid assembly of the flats, the coupling element and the chains. The coupling element is so constructed that an unintended outward movement thereof from the opening in the flat head is prevented while the flat chain pulls the flats along the carding cylinder during operation.

BRIEF DESCRIPTION OF THE DRAWING

FIG. 6*a* is a front elevational view of a fourth preferred embodiment of the invention.

FIG. 6*b* is a perspective view of a component shown in FIG. 6*a*.

FIG. 7*a* is an elevational view of a component of a fifth preferred embodiment.

FIG. 7*b* is a sectional view of an enlarged detail of FIG. 7*a*.

FIG. 7*c* is a schematic side elevational view of a component of the fifth preferred embodiment cooperating with the component shown in FIGS. 7*a* and 7*b*.

FIG. 7*d* is a fragmentary front elevational view of the component of FIG. 7*c*.

FIG. 7*e* is a fragmentary top plan view of the component shown in FIGS. 7*c* and 7*d*.

FIG. 8 is a top plan view of a sixth preferred embodiment of the invention.

FIG. 9 is a front elevational view of a seventh preferred embodiment of the invention.

DESCRIPTION OF THE PREFERRED EMBODIMENTS

Figure 1:
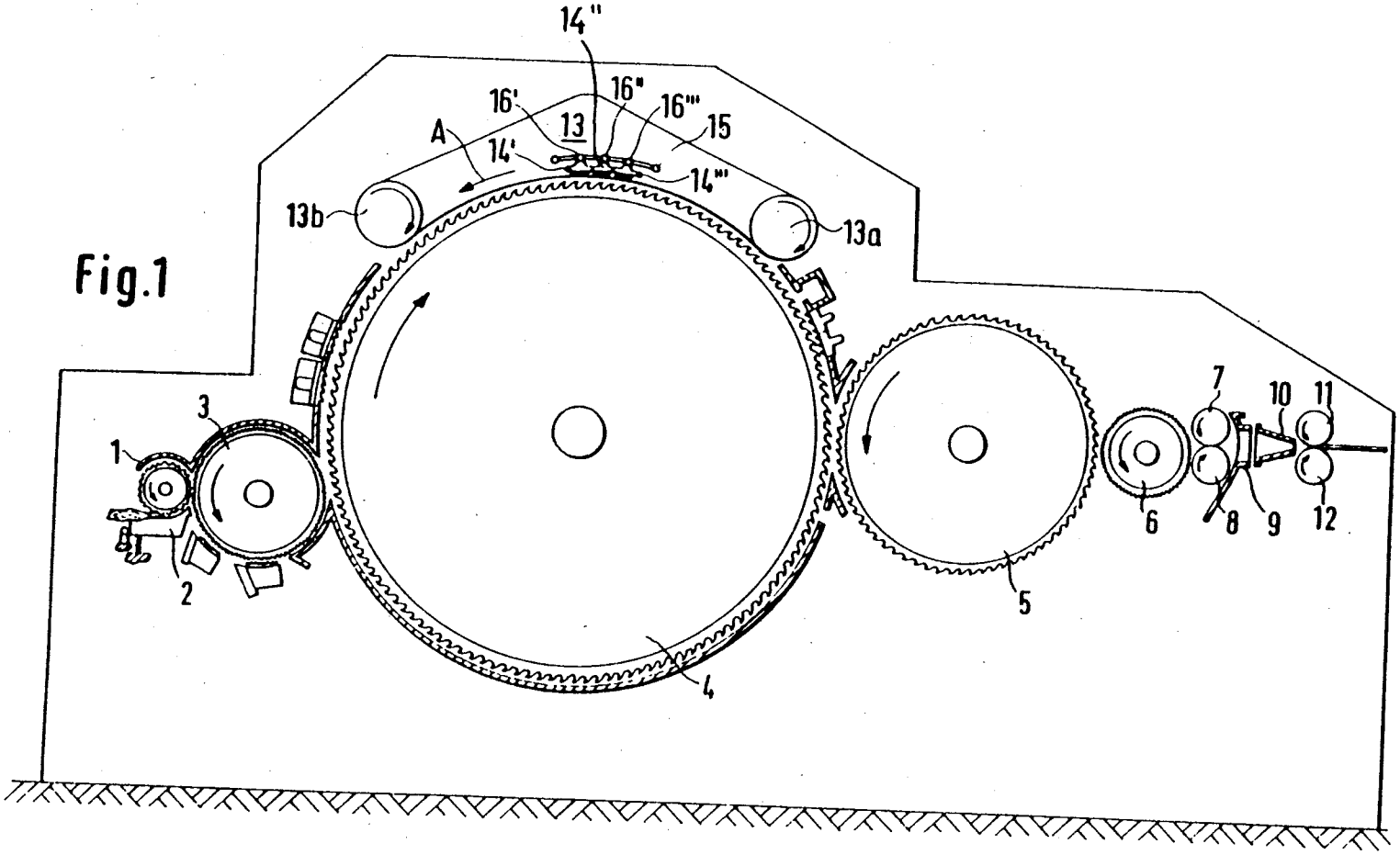
FIG. 1 is a schematic side elevational view of a carding machine incorporating the invention.

Turning to FIG. 1, there is illustrated a carding machine which may be, for example, an EXACTACARD DK 740 model, manufactured by Trützschler GmbH & Co. KG, Mönchengladbach, Federal Republic of Germany. The carding machine has a feed roller 1, a feed table 2 cooperating therewith, a licker-in 3, a main carding cylinder 4, a doffer 5, stripping rollers 6, crushing rollers 7, 8, a web guiding element 9, a sliver trunpet 10, calender rollers 11, 12 as well as travelling flats 13 supported by end rollers 13*a*, 13*b* which are rotated in a direction opposite to that of the main carding cylinder 4. The flats (flat bars) 14', 14'', 14''' are pulled by the flat chain 15 in the direction of the arrow A. As shown in FIG. 3*b*, the flat chain 15 is releasably secured by a coupling pin 16 to an end of the flat head 14*a*. According to the invention and as described in greater detail below, the coupling pin is retained in the flat head 14*a* in a form-locking manner and is thus prevented from unintentional removal from the flat head.

Figure 2A:
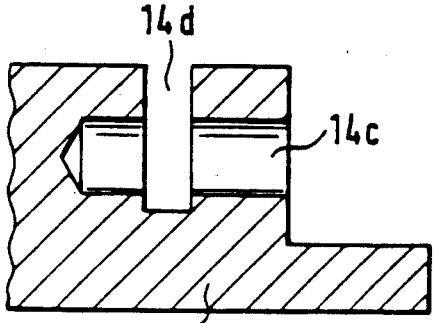
FIG. 2*a* is a fragmentary sectional elevational view of a flat head forming a component of a first preferred embodiment of the invention.
Figure 2B:
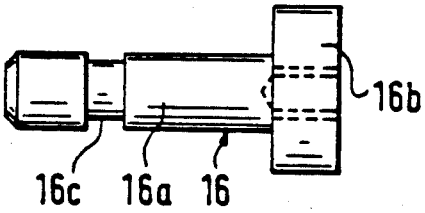
FIG. 2*b* is an elevational view of a coupling element forming another component of the first preferred embodiment of the invention.
Figure 2C:
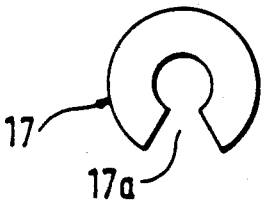
FIG. 2*c* is a plan view of still another component of the first preferred embodiment of the invention.

Turning to FIG. 2*a*, in the flat head 14*a* there is provided a blind bore 14*c* which extends parallel to the length dimension of the elongate flat (which, in turn, is oriented transversely to the direction of its travel). A slot 14*d* is provided in the flat head 14*a* in a direction transversely to the bore 14*c* and intersecting the same. FIG. 2*b* shows a coupling pin 16 adapted to be fitted into the bore 14*c*. The coupling pin 16 has a shank 16*a* and a head 16*b*. The shank 16*a* has a circumferential groove 16*c*. FIG. 2*c* illustrates a locking element formed of an elastic circlip 17 having a discontinuity at 17*a* and adapted to surround the groove 16*c* as will be discussed below.

Figure 3A:
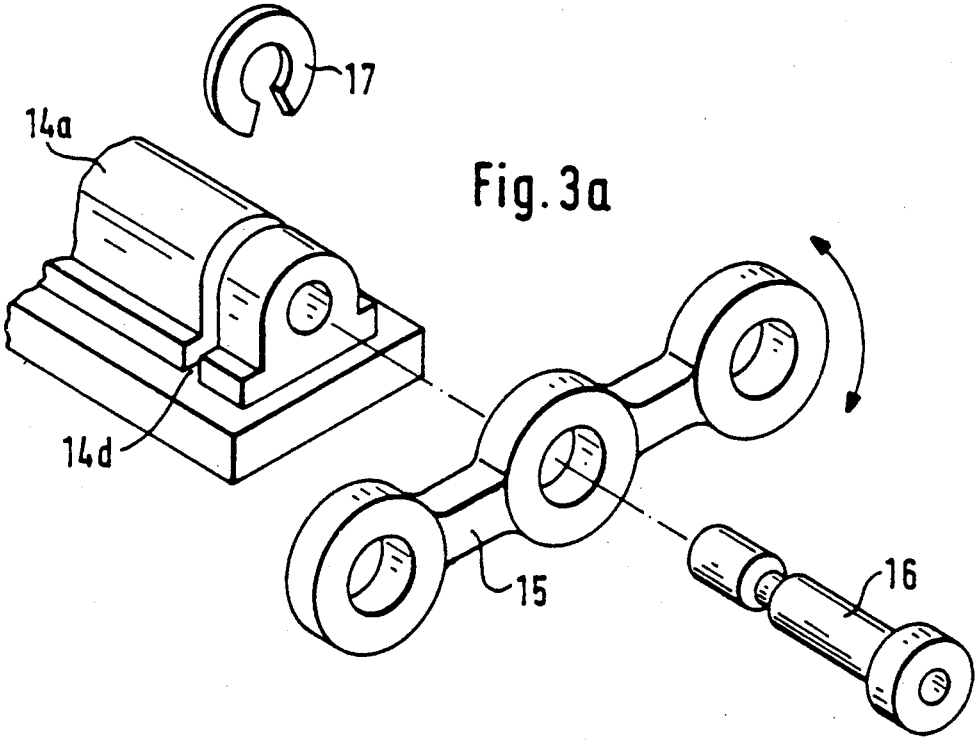
FIG. 3*a* is a perspective exploded view of the components of the first preferred embodiment of the invention.
Figure 3B:
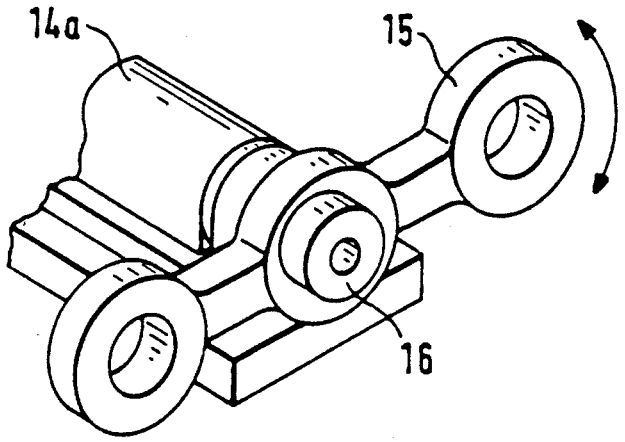
FIG. 3*b* is a perspective view of the components of the first preferred embodiment in an assembled state.

FIG. 3*a* shows, in an exploded view, the relative position of the flat head 14*a*, the flat chain 15, the coupling pin 16 and the circlip 17, while FIG. 3*b* shows these components in an actual assembled state. The elastic circlip 17 is received in the slot 14*d* and, within the groove 14*c*, projects into the groove 16*c* of the pin shank 16*a* and closely surrounds the groove bottom after it has been snapped-in.

Figure 4:
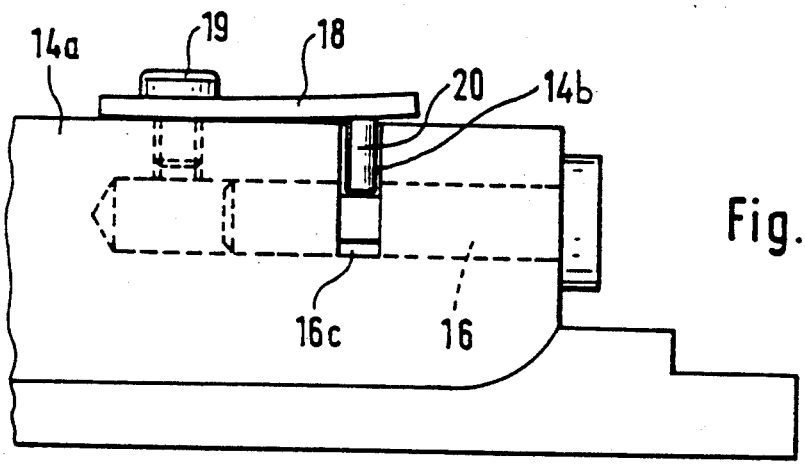
FIG. 4 is a front elevational view, partially in section, of a second preferred embodiment of the invention.

FIG. 4 illustrates a spring-biased locking arrangement, including a leaf spring 18 mounted at one of its ends on the flat head 14*a* by a screw 19. At its other end the leaf spring 18 carries a pin 20 which projects through a bore 14*b* in the flat head 14*a* and extends, with its free end, into the groove 16*c* of the coupling pin 16.

Figure 5:
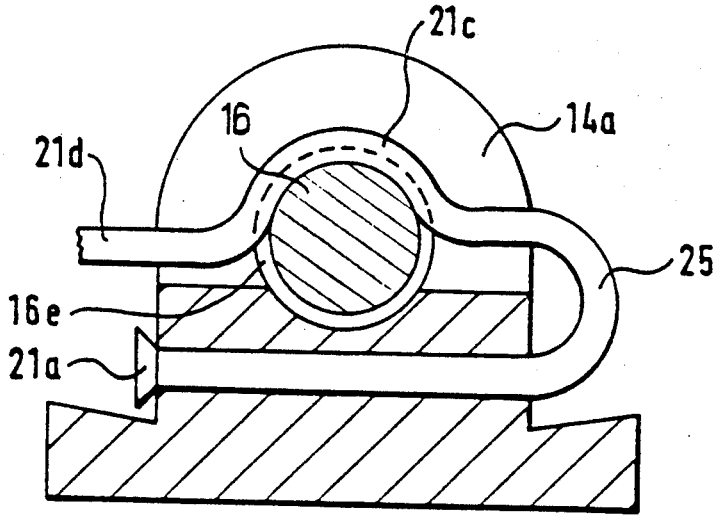
FIG. 5 is a sectional end view of a third preferred embodiment of the invention.

FIG. 5 illustrates an embodiment in which a bent spring 21 is secured at one end 21*a* to the flat head 14*a*. Adjacent its other end 21*d*, the spring 21 has an arcuate portion 21*c* which lies in the pin groove 16*c*, thus immobilizing (locking) the pin 16.

In the embodiment according to FIGS. 6*a* and 6*b*, the pin locking arrangement comprises a yoke 22 which has a leg portion 22*a* provided with a bore hole 22*b*, an oppositely located leg portion 22*c* having a throughgoing bore hole 22*d* provided with a lateral opening 22*e*. The yoke 22 is inserted into slots 14*d* and 14*d'* of the flat head 14 and a pin 23 is pushed into the bore 22*b*. The coupling pin 16 is pushed through the opening 22*d* and the leg portion 22*c* resiliently snaps into the groove 16*c* of the pin 16 to thus immobilize the latter in the bore 14*c* of the flat head 14*a*.

Turning to FIG. 7*a*, in the embodiment illustrated therein, the shank 16*a* of a coupling pin 16' is provided with a radial bore 16*d* having an inner thread into which there is threaded a screw 23. As shown in FIG. 7*b*, the screw 23 is provided with a blind bore 23*a* in which there is held an arresting pin 231, which, with its rounded end, projects beyond the radial end face of the screw 23. The other, flat opposite end of the arresting pin 23*b* is, with the intermediary of a spring 23*c*, supported on a bottom face of the bore 23*a*. As illustrated in FIGS. 7*c*, 7*d* and 7*e*, the flat head 14*a* has a radial bore 14*e* which communicates with and is transverse to, the flat head bore 14*c*. When the coupling pin 16' is to be removed from the flat head 14*a*, first the arresting pin 23 is pushed in by a simple tool, for example, by a small bar or nail introduced through the bore 14*e*, to be in a withdrawn position relative to the bore 14*e*, so that the securing bolt 16 may be pulled out of the bore 14*c*.

Turning to FIG. 8, in the embodiment illustrated therein, a coupling pin 16'' which has at its free end a slot 16*e* defining an enlarged forked construction formed of tines 16*f* and 16*g*, having an outwardly projecting enlargement 16*h* and 16*i*, respectively. The tines 16*f* and 16*g* are elastic so that they can expand (latch) into the slot 14*d* provided in the flat head 14*a*.

FIG. 9 illustrates a modification of the embodiment of FIG. 8, wherein the tines 16*f'* and 16*g'* of a coupling pin 16''' are pressable outwardly by means of a screw 24 which is positioned along an axial inner bore 16*k* having an inner thread 16*m*. The tines 16*f'* and 16*g'* are thus pressed against the inner wall of the bore 14*c*, so that the coupling pin 16''' is firmly anchored. The inner bore 14*c* is cylindrical and an anchoring of the coupling pin 16''' is effected by friction. To ensure a form-fitting relationship between tines and bore wall, the bore 14*c* may conically slightly widen from the end face of the flat head 14*a* inwardly.

It will be understood that the above description of the present invention is susceptible to various modifications, changes and adaptations, and the same are intended to be comprehended within the meaning and range of equivalents of the appended claims.

What is claimed is:

1. In a travelling flat bar having a head, a bore hole in the head, said bore hole having an axis, a coupling element received in the bore hole and being arranged for attaching the flat bar to a flat-moving chain and securing means for readily releasably retaining said coupling element in said bore hole; the improvement wherein said coupling element comprises a coupling pin including a pin shank having a threadless surface and being provided with a recess; said pin being axially slidably introducible into and withdrawable from said bore hole; said head having a slot oriented transversely to the bore hole axis and communicating with said bore hole; said securing means being a circlip insertable in said head through said slot; in a locking position said circlip projecting into said recess in the shank and into said slot in the head for preventing said pin from being withdrawn from said bore hole.

2. A travelling flat bar as defined in claim 1, wherein said recess is a circumferential groove.

3. A travelling flat bar as defined in claim 2, further wherein said circlip is a resilient circlip insertable in said head through said slot; in the locking position said circlip projects into said groove in the shank and into said slot in the head and assumes a snapped-in state about said shank.

* * * * *